United States Patent [19]

Harwick et al.

[11] 3,985,985

[45] Oct. 12, 1976

[54] BRAKE FLUID LEVEL SENSING SYSTEM

[75] Inventors: Duane H. Harwick; Michael M. Schardt, both of Kettering, Ohio

[73] Assignee: General Motors Corporation, Detroit, Mich.

[22] Filed: Apr. 21, 1975

[21] Appl. No.: 569,882

[52] U.S. Cl. ..... 200/81.4; 200/61.2; 200/84 B; 200/83 A; 73/403; 116/118 R; 340/52 C

[51] Int. Cl.[2] ..... H01H 35/18

[58] Field of Search ..... 200/61.2, 81.4, 81.5, 200/84 R, 84 B, 82 D, 83 W, 83 A, 83 J, 83 B, 83 R; 116/118 R; 73/403; 340/52 C, 242, 244

[56] References Cited

UNITED STATES PATENTS

| | | | |
|---|---|---|---|
| 2,907,844 | 10/1959 | Lindsey | 200/61.2 |
| 3,541,282 | 11/1970 | Kretchman | 200/82 D |
| 3,577,121 | 5/1971 | Wing | 200/84 R |
| 3,606,764 | 9/1971 | Yokouchi | 200/81.4 |

*Primary Examiner*—Gerald P. Tolin
*Attorney, Agent, or Firm*—Howard N. Conkey

[57] ABSTRACT

A hydraulic brake fluid level sensing system having a switch housing above a diaphragm which sealingly encloses a fluid reservoir. A float rod guide extends through the diaphragm and a float rod extends through the rod guide and into the switch housing. A float vertically positions the float rod in accordance with brake fluid level. A switch element is positioned by the float rod to bridge a pair of contacts when the fluid level decreases to a specified level. A slot is provided in the rod guide to provide a vent to the fluid reservoir when the diaphragm is moved down the rod guide by differential pressure thereacross resulting from brake fluid loss.

2 Claims, 3 Drawing Figures

BRAKE FLUID LEVEL SENSING SYSTEM

This invention relates to a fluid level sensing system for use in a brake fluid reservoir. More specifically, this invention relates to a switch for use in a diaphragm enclosed brake fluid reservoir wherein the movement of the diaphragm into the reservoir resulting from the differential pressure thereacross when the brake fluid level decreases is limited by venting the fluid reservoir to atmosphere when the diaphragm has moved into the reservoir a specified amount.

Master cylinder hydraulic fluid reservoirs used in vehicle braking systems may employ a diaphragm to seal the hydraulic fluid reservoir from the atmosphere ambient to prevent moisture from entering the reservoir which is readily absorbed by the hydraulic brake fluid. The general object of this invention is to provide an improved brake fluid level sensing system for use with a braking system of this type.

It is another object of this invention to provide a brake fluid level sensing system for use with a brake fluid reservoir having a diaphragm enclosing the reservoir chamber wherein movement of the diaphragm into the reservoir resulting from decreasing hydraulic fluid level is limited.

It is another object of this invention to provide a brake fluid level sensing assembly for use with a diaphragm enclosed hydraulic brake fluid reservoir wherein a vent is provided on the switch assembly to vent the reservoir to atmospheric pressure when the diaphragm is moved a specified amount by the differential pressure thereacross resulting from decreasing hydraulic brake fluid levels.

These and other objects of this invention are accomplished by providing a hydraulic brake fluid level sensing system in a diaphragm enclosed brake reservoir wherein a switch housing is provided on the external side of the diaphragm. A rod guide extends through the diaphragm and into the brake fluid reservoir. A float vertically positions a float rod within the rod guide which in turn controls a switch which is actuated when the fluid in the reservoir decreases to a specified level. The rod guide includes a slot at a position representing the maximum desired displacement of the diaphragm caused by the differential pressure thereacross resulting from decreasing hydraulic brake fluid levels. The brake fluid reservoir is vented to atmospheric pressure when the diaphragm is moved down the rod guide by the differential pressure thereacross to the slot to thereby limit the downward movement of the diaphragm caused by differential pressure thereacross.

The invention may be best understood by reference to the following description of a preferred embodiment and the drawings wherein.

Figure 1:
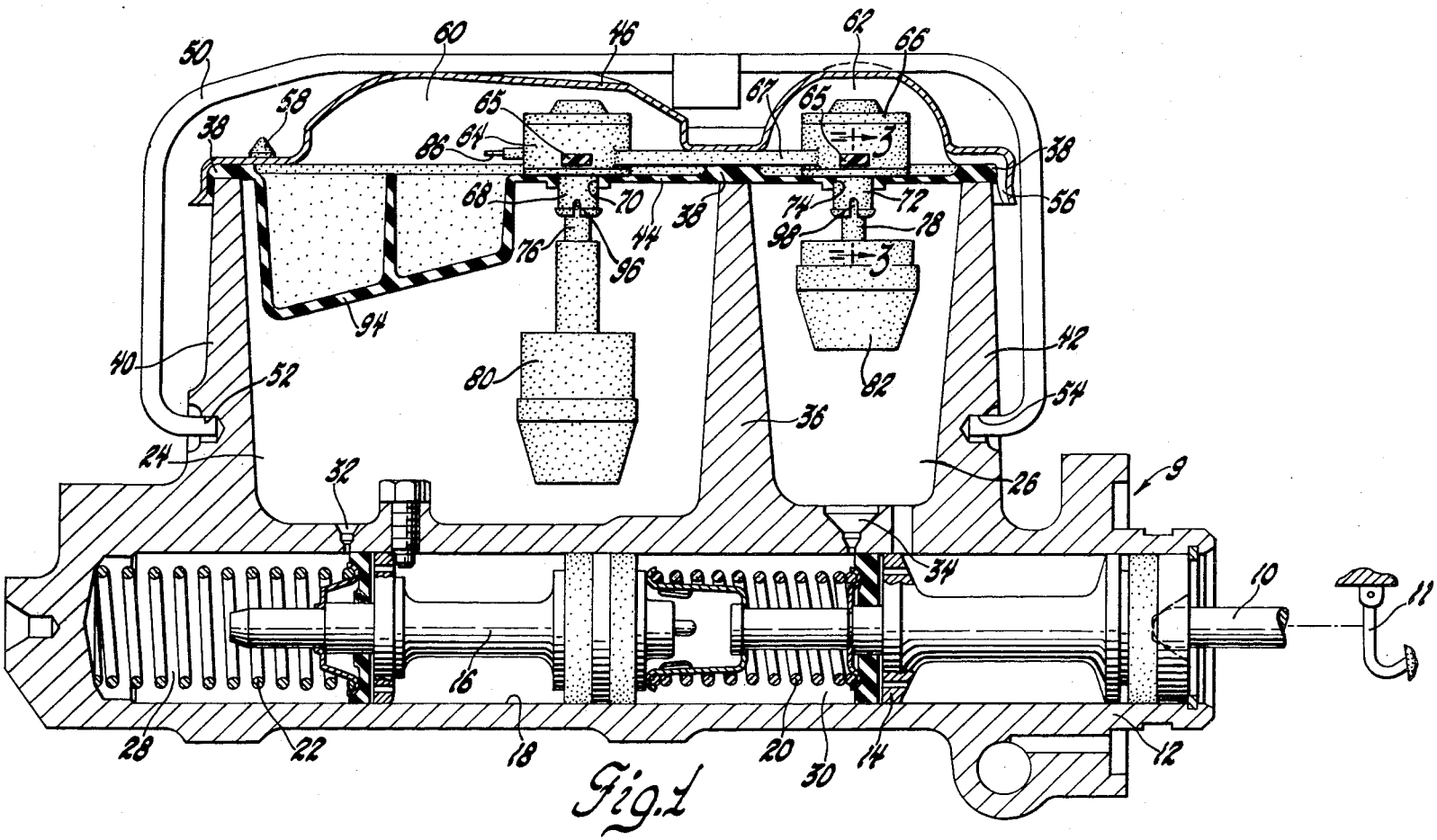
FIG. 1 is a cross-sectional side elevational view of a dual master cylinder assembly employing a pair of brake fluid level switch assemblies of this invention.
Figure 2:
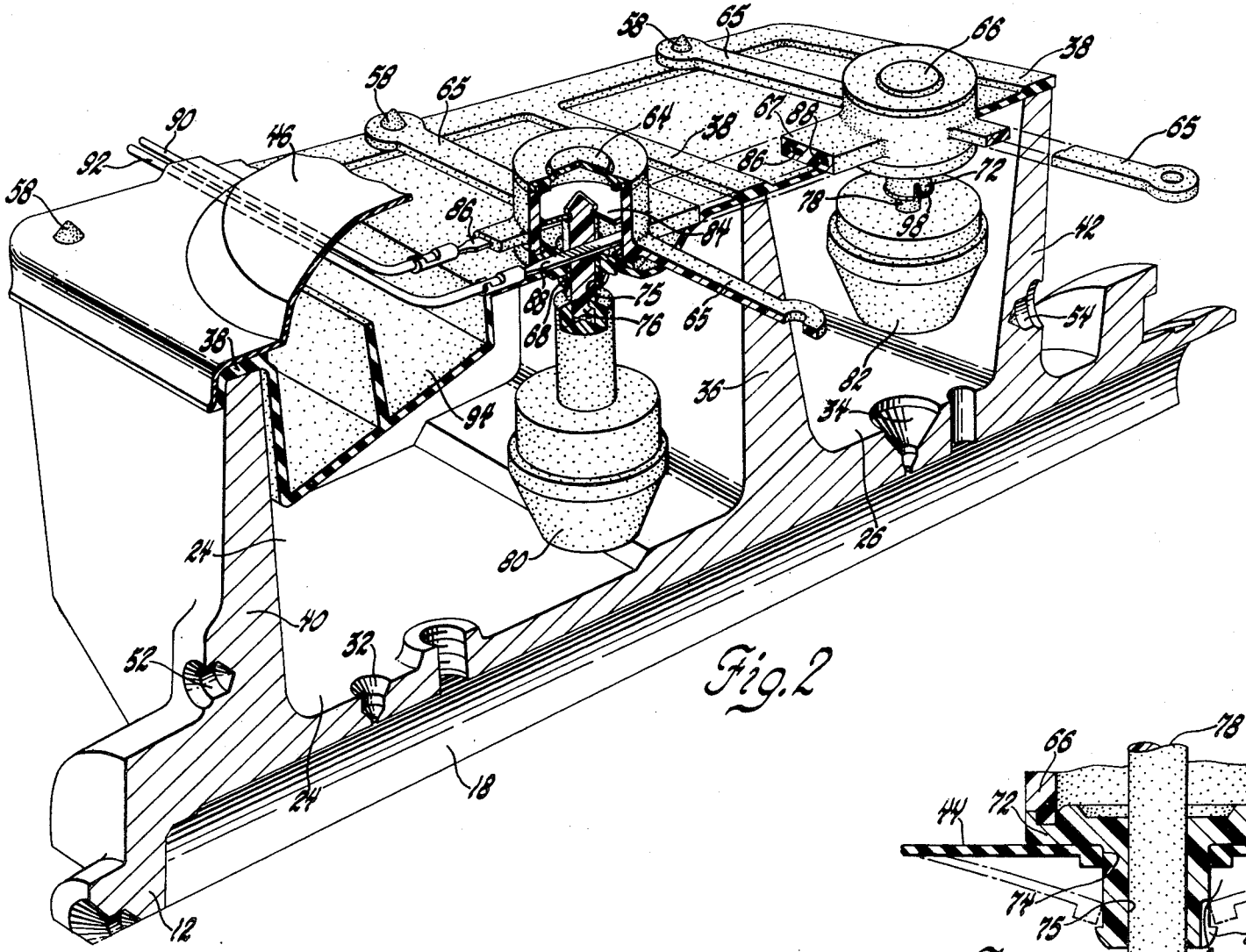
FIG. 2 is an isometric view of a portion of the assembly of FIG. 1 partly broken away to illustrate the fluid level switch of this invention.

Referring to FIGS. 1 and 2, a vehicle brake system is schematically shown including a master cylinder 9 which is actuated by a push rod 10 from a brake pedal 11 in the vehicle brake compartment. Pressurized fluid is discharged from the master cylinder 9 to respective front and rear vehicle wheel brake assemblies through fluid passages (not shown). A master cylinder body 12 contains a first piston 14 and a second piston 16 slidably disposed within a cylinder 18, each piston being spring biased to a retracted position by springs 20 and 22 respectively. The master cylinder body 12 also includes brake fluid reservoirs 24 and 26 which supply fluid to pressurizing chambers 28 and 30 through make-up ports 32 and 34 for pressurization and transmittal to the respective wheel brake assemblies. The reservoirs 24 and 26 are separated by a web portion 36 which supports a fluid sealing gasket 38 also resting upon walls 40 and 42 which cooperate with the web portion 36 to define the reservoirs 24 and 26.

A diaphragm 44 is integrally formed with the fluid sealing gasket 38 and encloses the fluid chambers 24 and 26.

A dual reservoir cover assembly 46 is retained in place by a bail 50 pivotally mounted in recesses 52 and 54 in the walls 40 and 42. The volume between the cover 46 and the diaphragm 44 is vented to the atmosphere by vents such as vent 56 illustrated in FIG. 1.

The diaphragm 44 is secured to the cover 46 by knobs 58 integrally formed with the diaphragm 44 which extend through corresponding openings in the cover 46 and lock into place on the outer surface of the cover 46.

The cover 46 is dome shaped over each of the reservoirs 24 and 26 and thereby forms a pair of chambers 60 and 62 between the cover 46 and the diaphragm 44. A switch housing 64 and a switching housing 66 are mounted within the respective chambers 60 and 62 by mounting arms 65 which extend laterally and contain openings through which corresponding knobs 58 extend to effectively secure the switch housings 64 and 66 to the cover 46. The switching housings 64 and 66 are coupled by a spanning member 67 integrally formed therewith. The switch housings 64 and 66 and the spanning member 67 are made from electrically nonconducting material. An electrically nonconductive rod guide 68 is secured to the switch housing 64 and has a stem portion which extends through the aperture 70 in the diaphragm 44, the diaphragm 44 sealingly engaging the periphery thereof. An electrically nonconducting rod guide 72 is secured to the switch housing 66 and has a stem portion which extends through an aperture 74 in the diaphragm 44, the diaphragm 44 sealingly engaging the periphery thereof. The diaphragm 44 has a spring rate which self biases it upwards toward the switch housings 64 and 66.

The rod guides 68 and 72 each have bores therethrough, such as bore 75 illustrated in FIG. 2, extending between the switch housings 64 and 66 and the respective reservoirs 24 and 26. A pair of float rods 76 and 78 are slidably and sealingly disposed within the bores in the rod guides 68 and 72, respectively. A float 80 is secured to the lower end of the float rod 76 extending into the reservoir 24 so as to vertically position the float rod 76 in accordance with the fluid level within the chamber 24. Conversely, a float 82 is coupled to the end of the float rod 78 extending into the reservoir 26 to vertically position the float rod 78 in accordance with the fluid level within the reservoir 26.

A disc contact 84, illustrated in FIG. 2, is secured to the end of the float rod 76 extending into the switch housing 64. Similarly, a disc contact (not shown) is secured to the end of the float rod 78 extending into the switch housing 66.

A pair of contacts 86 and 88 extend through the switch housing 64, the spanning member 67 and into the switch housing 66. The disc 84 electrically bridges the contacts 86 and 88 when the float 80 is lowered by decreasing fluid level in the reservoir 24 to a specified level. In the same manner, the contacts 86 and 88 are electrically bridged when the float 82 is lowered by decreasing fluid level in the reservoir 26 to a specified level. A pair of leads 90 and 92 couple the contacts 86 and 88 to an appropriate warning circuit (not shown) to provide a warning when the fluid in either one of the chambers 24 or 26 decreases to the respective specified levels at which the terminals 86 and 88 are electrically bridged.

Because the master cylinder 9 of FIG. 1 may be mounted on an incline with the wall 42 at a lower level than the wall 40, the diaphragm 44 includes a portion 94 extending down into the larger reservoir 24. The bottom surface of the portion 94 is at a similar incline so that it is approximately horizontal and at the level of the fluid when the reservoir 24 is filled. In this manner, splashing and fluid movement which may otherwise provide for an erratic indication of low fluid level within the reservoir 24 is prevented.

Since the reservoirs 24 and 26 are sealed from the atmosphere by the gasket 38 and the diaphragm 44 formed therewith, a decreasing fluid level within the chambers 24 or 26 creates a pressure differential across the diaphragm 44. This pressure differential may cause the diaphragm to move downward along the rod guides 68 and 72 into the reservoirs 24 and 26, respectively. If this downward movement is not arrested, the diaphragm may be caused to unsnap from the end of the rod guide 68 or 72 in the reservoirs 24 and 26 and jam or otherwise affect movement of the floats 80 and 82.

Figure 3:
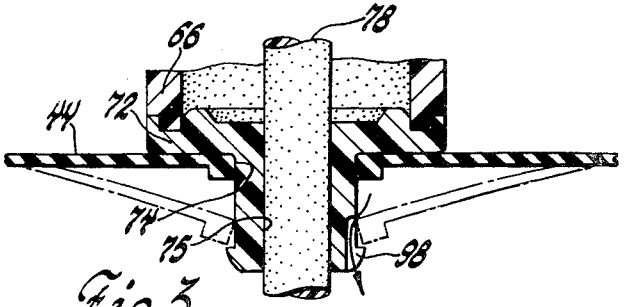
FIG. 3 is a view of the rod guide of the fluid level switch of FIGS. 1 and 2 as viewed along lines 3—3 of FIG. 1.

To limit the downward movement of the diaphragm 44 along the rod guides 68 and 72 and thereby prevent it from affecting movement of either the float 80 or the float 82, a vertical slot 96 is provided in the lower end of the rod guide 68 and a vertical slot 98 is provided in the lower end of the rod guide 72. As seen in FIG. 3 and with reference to the rod guide 72, when the diaphragm 44 is moved down the rod guide 72 to the broken line position over the slot 98 by the differential pressure thereacross resulting from decreasing fluid level in the reservoir 26, the reservoir 26 is vented to the atmosphere through the slot 98. Air enters the reservoir 26 through the slot 98 from the chamber 62 which is at atmospheric pressure until the differential pressure across the diaphragm 44 is decreased and the diaphragm is again moved upward by its self bias force along the rod guide 72 to again seal around the periphery of the rod guide 72. In this manner, the movement of the diaphragm 44 along the rod guide 72 is limited by the location of the slot 98. In like manner, the movement of the diaphragm downward on the rod guide 68 is limited by the position of the slot 96 which vents the reservoir 24 to the atmosphere.

Although the invention has been described with reference to a dual reservoir system requiring two float actuated switches, it is equally applicable to a single reservoir system wherein only a single float actuated switch is provided.

The foregoing description of a preferred embodiment of the invention for the purpose of illustrating the principles thereof is not to be considered as limiting or restricting the invention as many modifications may be made by the exercise of skill in the art without departing from the scope of the invention.

We claim:

1. A hydraulic brake fluid level sensing system for use with a hydraulic vehicle brake system having a brake fluid reservoir, said system comprising: a cover member for enclosing the reservoir; a diaphragm positioned between the cover member and the fluid reservoir, the diaphragm and the cover member forming a chamber therebetween; means for venting the chamber to the atmosphere; and fluid level sensor means responsive to fluid level variations in the reservoir, said fluid level sensor means including a stationary guide means extending from the chamber to the reservoir through the diaphragm, the diaphragm normally sealingly engaging the periphery of the stationary guide means and sealingly engaging the reservoir to normally seal the reservoir from the chamber, the diaphragm being moved down the stationary guide means by differential pressure thereacross resulting from a decrease in brake fluid level in the reservoir, the stationary guide means having a slot therein proximate the end thereof in the reservoir, whereby movement of the diaphragm down the stationary guide by the differential pressure thereacross resulting from loss of brake fluid is limited by venting of the reservoir to atmosphere when the diaphragm is moved to a position over the slot in the stationary guide means.

2. A hydraulic brake fluid level sensing system for use with a hydraulic vehicle brake system having a brake fluid reservoir, said system comprising: a cover member for enclosing the reservoir; a diaphragm positioned between the cover member and the fluid reservoir, the diaphragm and the cover member forming a chamber therebetween; means for venting the chamber to the atmosphere; a switch housing within the chamber, the switch housing being secured to the cover member; a rod guide secured to the switch housing and having a stem portion extending vertically downward through the diaphragm and into the reservoir, the diaphragm normally sealingly engaging the periphery of the stem portion and sealingly engaging the reservoir to normally seal the reservoir from the chamber, the diaphragm being moved down the stem by differential pressure thereacross resulting from a decrease in brake fluid level in the reservoir, the rod guide having a bore extending therethrough between the switch housing and the reservoir and the stem portion having a slot therein proximate the end thereof in the reservoir; a float rod vertically slidable through the bore in the rod guide; a float secured to the end of the float rod in the reservoir for vertical movement thereof in response to brake fluid level variations in the reservoir; and switch means in the switch housing, said switch means being operated by the upper end of the float rod when the level of brake fluid in the reservoir is below a specified level, whereby movement of the diaphragm down the stem portion by the differential pressure thereacross resulting from loss of brake fluid is limited by venting of the reservoir to atmosphere when the diaphragm is moved to a position over the slot in the stem portion.

* * * * *